US011535988B1

(12) United States Patent
Han et al.

(10) Patent No.: US 11,535,988 B1
(45) Date of Patent: Dec. 27, 2022

(54) WATER DAMPING DEVICE AND METHOD FOR CONTROLLING VORTEX-INDUCED VIBRATION AND FLUTTERING OF SEA-CROSSING OR RIVER-CROSSING BRIDGES

(71) Applicant: Changsha University of Science and Technology, Changsha (CN)

(72) Inventors: Yan Han, Changsha (CN); Kai Li, Changsha (CN); Yusheng Xu, Changsha (CN); Fuyou Xu, Changsha (CN); Chunguang Li, Changsha (CN); Peng Hu, Changsha (CN)

(73) Assignee: Changsha University of Science and Technology, Changsha (CN)

( * ) Notice: Subject to any disclaimer, the term of this patent is extended or adjusted under 35 U.S.C. 154(b) by 0 days.

(21) Appl. No.: 17/856,142

(22) Filed: Jul. 1, 2022

(30) Foreign Application Priority Data

Jul. 12, 2021 (CN) ..... 202110783353.3

(51) Int. Cl.
*E01D 19/14* (2006.01)
*E01D 11/04* (2006.01)

(52) U.S. Cl.
CPC ..... *E01D 19/14* (2013.01); *E01D 11/04* (2013.01)

(58) Field of Classification Search
CPC ..... E01D 19/14; E01D 19/08; E01D 11/04
See application file for complete search history.

(56) References Cited

U.S. PATENT DOCUMENTS 6,292,967 B1 * 9/2001 Tabatabai ..... F16F 7/104 188/380
6,406,221 B1 * 6/2002 Collier ..... E02B 17/0017 114/220
6,484,458 B1 11/2002 Park
2022/0178092 A1 * 6/2022 Sun ..... E01D 19/14

FOREIGN PATENT DOCUMENTS

| | | | |
|---|---|---|---|
| CN | 103866876 | A | 6/2014 |
| CN | 105951581 | A | 9/2016 |
| CN | 110630076 | A | 12/2019 |
| CN | 112458880 | A | 3/2021 |
| CN | 112459586 | A | 3/2021 |
| CN | 112942069 | A | 6/2021 |
| CN | 113005880 | A | 6/2021 |
| JP | 2007218380 | A | 8/2007 |

OTHER PUBLICATIONS

First Office Action issued in counterpart Chinese Patent Application No. 202110783353.3, dated Nov. 12, 2021.

* cited by examiner

*Primary Examiner* — Abigail A Risic
(74) *Attorney, Agent, or Firm* — Westbridge IP LLC

(57) ABSTRACT

A water damping device includes a steel frame and a water-blocking cup; the device is immersed in the water and connected under the main bridge girder by wire ropes. One end of the water-blocking cup is provided with a blocking ring and a cover. The water-blocking cup cover is mounted between the cup and the blocking ring and is movably connected to the water-blocking cup. The blocking ring is used to prevent the water-blocking cup cover from opening towards the outside of the cup; an array of water-blocking cups is mounted on the steel frame along the downward direction of the water-blocking cup cover.

7 Claims, 4 Drawing Sheets

WATER DAMPING DEVICE AND METHOD FOR CONTROLLING VORTEX-INDUCED VIBRATION AND FLUTTERING OF SEA-CROSSING OR RIVER-CROSSING BRIDGES

CROSS-REFERENCE TO RELATED APPLICATIONS

The application claims priority to Chinese Patent Application No. 202110783353.3, filed on Jul. 12, 2021, the entire contents of which are incorporated herein by reference.

TECHNICAL FIELD

The present application relates to the technical field of vibration control for building structures, particular to a water damping device and a water damping method for controlling VIV and flutter of sea-crossing or river-crossing bridges.

BACKGROUND

Long-span bridges are featured by large spans, flexible structures, and low damping, among others; hence, they are more sensitive to wind effects. When the wind blows through the section of main girder, vortex shedding will occur on the downstream side of the main girder, which will exert alternating upward and downward forces on the bridge. As the wind speed accelerates, the frequency of vortex shedding also increases. When the shedding frequency is close to the natural frequency of the main girder, the main girder structure will experience the vortex-induced resonance phenomenon. Although VIV is limited in amplitude of oscillation and does not produce divergent vibrations like flutter and galloping, it is prone to occur at low wind speeds and at a high frequency. In the long run, it will cause fatigue damage to the structure and affect the comfort and driving safety of the bridge. Therefore, it is particularly important to control VIV. On the other hand, with the ever-growing length of the bridge span, some simple and low-cost measures of aerodynamic control are becoming increasingly inadequate to meet requirements for linear flutter theory. Meanwhile, the design and construction costs have been on the sharp rise. Due to the significant changes in the global climate, long-span bridges, especially those in coastal typhoon areas, will face more severe challenges of wind-induced vibration. According to the conventional theoretical framework of linear flutter, bridge flutter is considered to be a behavior of instability with devastating effects. Therefore, it is difficult for dampers to control the occurrence of flutter, and it has little effect on raising the critical flutter wind speed. However, in recent years a large number of scholars have found through wind tunnel tests and numerical simulation studies that many bridge sections currently exhibit limit cycle oscillation behavior, which is called "soft flutter" and is regarded as a complex issue of nonlinear response. In view of this, a damper is able to increase the wind speed and control the amplitude of such soft flutter. Therefore, it is urgently needed to develop a damper for controlling the response to soft flutter.

At present, the major measures for controlling VIV are pneumatic and mechanical. The mechanical control measures aim to reduce the wind-induced response of bridges by employing devices that increase the damping of the structure or by appropriately adding some heavy objects with certain mass. The common mechanical control measures make use of a tuned mass damper (TMD) and an eddy current damper (ECD), etc. However, they can only be used in a box girder that is high enough to accommodate the stroke of the damper. Therefore, the measures apply only to limited types of bridges and fail to solve the problem of multiple orders of VIVs. In addition, they entail a high cost of maintenance and are difficult to install. They control the vertical VIV well but can hardly rein in the torsional VIV. Compared with mechanical measures, aerodynamic control, including active and passive measures, is able to enhance the wind resistance performance of bridges from the perspective of improving the surrounding flow field. It has advantages of direct effect, simplicity, and economy.

Passive measures are used to obtain the flow around the section of bridge with good wind resistance through the appropriate revision of the bridge shape and layout or the addition of some devices (such as deflectors, flow-resisting plates, and vortex nets, etc.) without changing the bridge structure and functions. However, due to the complexity of the flow around the bridge section, passive aerodynamic measures are not widely applicable to the VIV control. These measures cannot be adjusted in real time according to the movement posture of the main girder and the change of the flow environment and thus fail to attain the optimal control effect. Furthermore, the scale model test has size effect during the wind tunnel experiment, so the control effect in the real-world scenario remains to be observed and verified. As far as the control of bridge flutter is concerned, given that the current design standard is based on the linear flutter theory, flutter can only be prevented by increasing the critical flutter wind speed through aerodynamic measures or structural measures. However, a large number of experiments have found that many bridge sections exhibit nonlinear response behaviors, such as soft flutter, and flutter itself is featured by two degrees of freedom of participation. Therefore, it is possible to develop dampers that can simultaneously control vibration in both vertical and torsional directions.

SUMMARY

The technical issue addressed by the present application is to overcome defects of the aforesaid water-crossing bridge background and to provide a water damping device and a water damping method for controlling VIV and flutter of sea-crossing or river-crossing bridges.

The present application provides a water damping device and a water damping method for controlling VIV and flutter of sea-crossing or river-crossing bridges. The device includes a water damping device that is immersed in the water and connected under the main girder by wire ropes; the water damping device includes a steel frame and a water-blocking cup. One end of the water-blocking cup is provided with a blocking ring and a water-blocking cup cover. The water-blocking cup cover is mounted between the water-blocking cup and the blocking ring and is movably connected to the water-blocking cup. The blocking ring is used to prevent the water-blocking cup cover from opening toward the outside of the water-blocking cup; an array of water-blocking cups is mounted on the steel frame along the downward direction of the water-blocking cup cover.

By immersing it in the water and connecting the water damping device under the main girder, the action force between the water resources under the bridge and the device is used to hinder the movement of the main girder. When the torsional vibration occurs, the water damping device at the raised end hinders the torsion of the main girder in order to control the torsional VIV and soft flutter. The present application is used mainly to control VIV and flutter, but it is not limited thereto and can control other forms of larger amplitude vibrations, such as wind-induced buffet.

Optionally, the water damping devices are mounted at points ½, ¼, and ⅛ of the length of the main girder.

The configuration of the water damping device at points ½, ¼, and ⅛ of the length of the main girder achieves the effect of controlling the first-order, second-order, and third-order VIVs.

Optionally, the device also includes an anchoring hole opened at the bottom of the main girder; the water damping device is connected to the anchoring hole by wire ropes.

Based on the configuration of anchoring holes at the bottom of the main girder, the water damping device is placed in the water and is connected by wire ropes to exert the effect of suppressing the VIV of bridges; after the VIV of bridges disappears and the wind environment of bridge deck is stabilized, the wire ropes are removed through the anchoring holes of the main girder, and the water damping device is detached and put away. This will not affect the underwater navigation or the aesthetics of the bridge.

Optionally, it includes a displacement stroke amplifier that is mounted adjacent to the bridge tower body at two ends of the main girder and connected to the water damping device.

Because the vibration displacement of the main girder adjacent to the side span of the bridge tower is relatively small, the displacement stroke of the water damping device is too weak to achieve a great control effect. Therefore, the stroke of the water damping device is amplified by installing a displacement stroke amplifier on the bridge tower body. This can achieve the effect of suppressing the vibration of the main girder.

Optionally, the displacement stroke amplifier comprises a reinforced rigid arm, a solid steel shaft, a small-radius roller, and a large-radius hub; one end of the reinforced rigid arm is connected to the bridge tower body, and the other end is connected to the small-radius roller; the solid steel shaft is embedded in the small-radius roller through balls; the large-radius hub and the small-radius roller are coaxially fixed.

Optionally, a groove is provided on the outer side of the small-radius roller; one end of the wire rope is wound in the groove on the outer side of the small-radius roller, and the other end is connected to the main girder; a groove is provided on the outer side of the large-radius hub; one end of the wire ropes 2 is wound in the groove on the outer side of the large-radius hub 44, and the other end is connected to the water damping device.

Based on the same angular displacement, the vibration displacement of the main girder is amplified by the radius multiple between the large-radius hub and the small-radius roller. This enables the water damping device to exert a damping effect, thereby suppressing VIV and soft flutter of the bridge.

Optionally, both sides of the bridge are equipped with the water damping device.

Optionally, the water-blocking cup cover is made of lightweight materials; the steel frame and the water-blocking cup are made of high-density materials.

The application also provides a water damping method for controlling VIV and flutter of sea-crossing or river-crossing bridges. The method is implemented using the aforesaid water damping device as a tool and comprises the following steps:

S1: placing the device into the water and connect the water damping device under the main girder through the wire ropes when the VIV and flutter of a bridge occurs.

S2: suppressing the VIV and flutter of bridges using the water damping device.

S3: removing the water damping device and putting it away after the VIV and flutter of bridge disappear.

Optionally, S2 is specifically implemented as below:

S2.1: during the upward movement of the main girder, the water damping device conducts the upward movement under the action of pulling force, and the water flow causes the water-blocking cup cover to seal the bottom of the water-blocking cup. This increases the resistance and damping to the upward movement of the main girder and dissipates partial kinetic energy of the upward movement of the main girder;

S2.2: during the downward movement of the main girder, the water damping device moves downward under the action of gravity, and the water flow causes the water-blocking cup cover to open toward the inside of the water-blocking cup; as the water flows through the water-blocking cup, the resistance to the downward movement of the steel frame is reduced and falls rapidly under the action of gravity, and the stroke of the water damping device is reserved for the next round of upward movement of the main girder. Accordingly, the water damping device has a strong enough stroke to consume the vibration energy of the main girder during the next round of upward movement.

The application comprises a water damping device and method for controlling VIV and flutter of sea-crossing or river-crossing bridges. It hinders the movement of the main girder by utilizing the action force between the water resources under the bridge and the device, so as to achieve the effect of suppressing the VIV or soft flutter of the bridge. The effect of controlling multiple orders of VIVs can be achieved by installing water damping devices at different span lengths of bridges. When VIV or large-scale buffeting or soft flutter occurs to the bridge, the installation of the present application can suppress the vibration and thus protect the bridge structure; the underwater device can be put away during the daily bridge operation without affecting the underwater navigation or the aesthetics of the bridge. The present application is used mainly to control VIV and flutter but is not limited thereto and can control other forms of vibration with large amplitudes, such as wind-induced buffeting.

BRIEF DESCRIPTION OF THE DRAWINGS

In order to elaborate the specific embodiments of the present application and the technical solutions more explicitly, the accompanying drawings are briefly introduced below.

DETAILED DESCRIPTION OF THE EMBODIMENTS

The technical solutions of the present application will be explicitly elaborated in their entirety below in conjunction with the accompanying drawings. Obviously, the stated embodiments are a part of rather than the entire embodiments of the present application. Based on the embodiments of the present application, all other embodiments obtained by those of ordinary skill in the art without creative work shall fall within the protection scope of the application.

In the description of the present application, it should be noted that the terms that indicate the relationship of orientations or positions such as "center," "upper," "lower," "left," "right," "vertical," "horizontal," "inside," and "outside" are based on the relationship of orientation or position as shown in the accompanying drawings. This intends solely to facilitate and simplify the description of the present application rather that to indicate or imply that the described device or element shall have a specific orientation or shall be constructed and operated in a particular fashion. Therefore, it shall not be interpreted as a limitation of the present application. Furthermore, the terms "first," "second," and "third" are used for description only and shall not be construed to indicate or imply relative importance.

In the description of the present application, it should be noted that, unless otherwise expressly specified and limited, the terms "mount," "connect," and "link" shall be understood in a broad sense. For instance, they may be construed to indicate a fixed connection, a detachable connection, an integral connection, a mechanical connection, or an electrical connection; they may also refer to a direct connection or an indirect connection through an intermediate medium or through internal linkage of two components. For those of ordinary skill in the art, the specific connotation of the aforesaid terms in the present application should be understood on a case-by-case basis.

In addition, the technical features stated in the various embodiments of the present application as described below can be combined with each other, as long as they do not conflict with one another.

Embodiment 1

Figure 1:
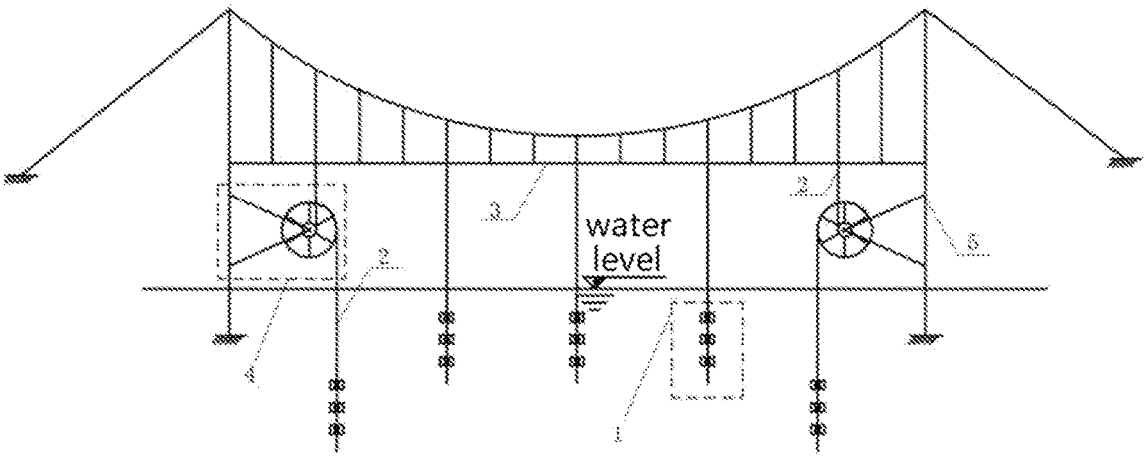
FIG. 1 is a front view of the water damping device for controlling VIV and flutter of sea-crossing or river-crossing bridges provided by the application connected to the bridge.
Figure 2:
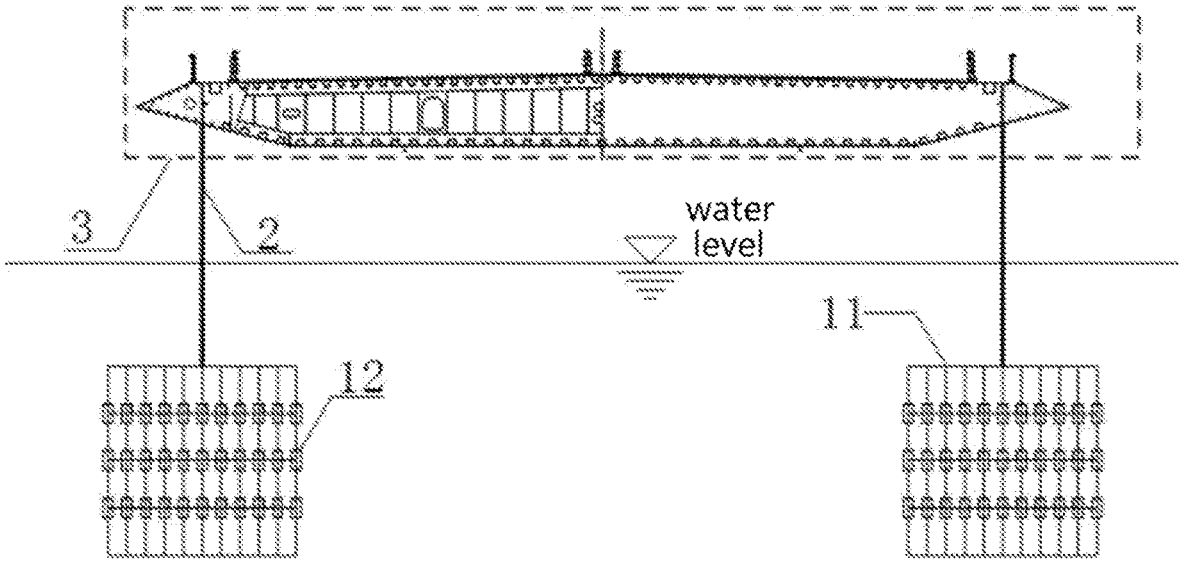
FIG. 2 is a side view of the water damping device for controlling VIV and flutter of sea-crossing or river-crossing bridges as provided by the application connected to the bridge.
Figure 3:
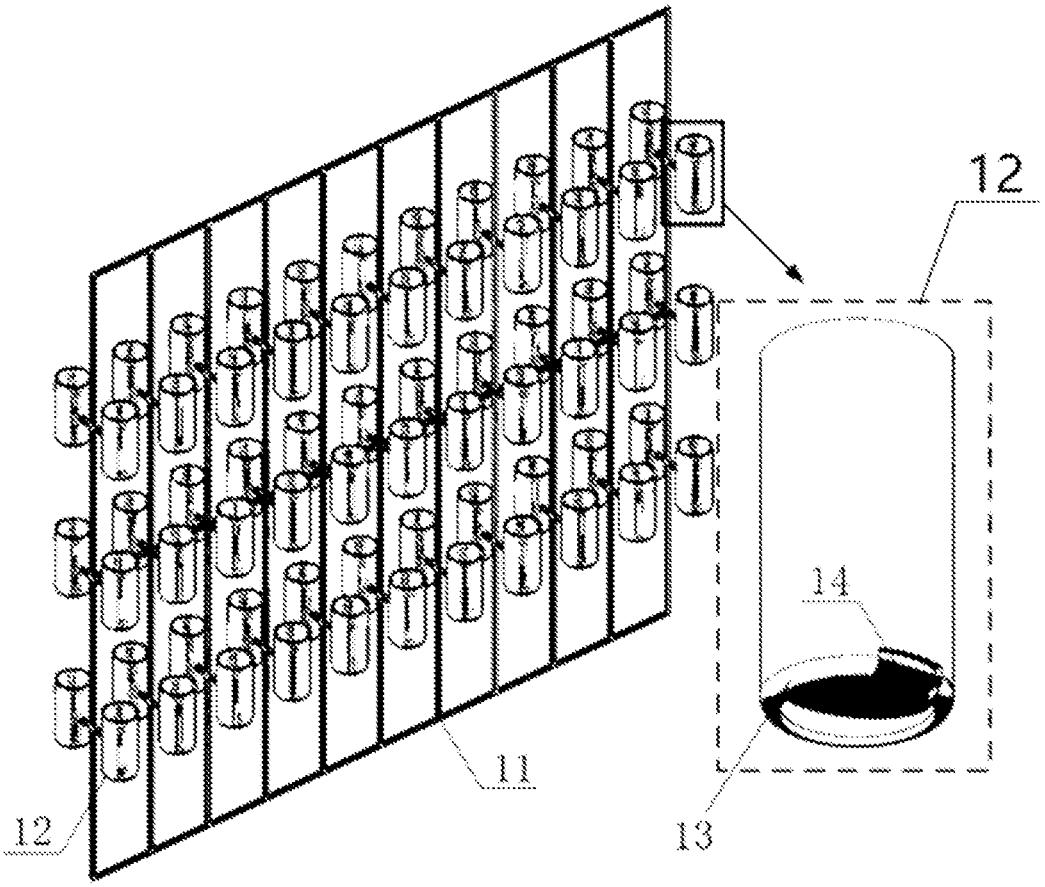
FIG. 3 is a structural representation of the water damping device provided by the application.
Figure 4:
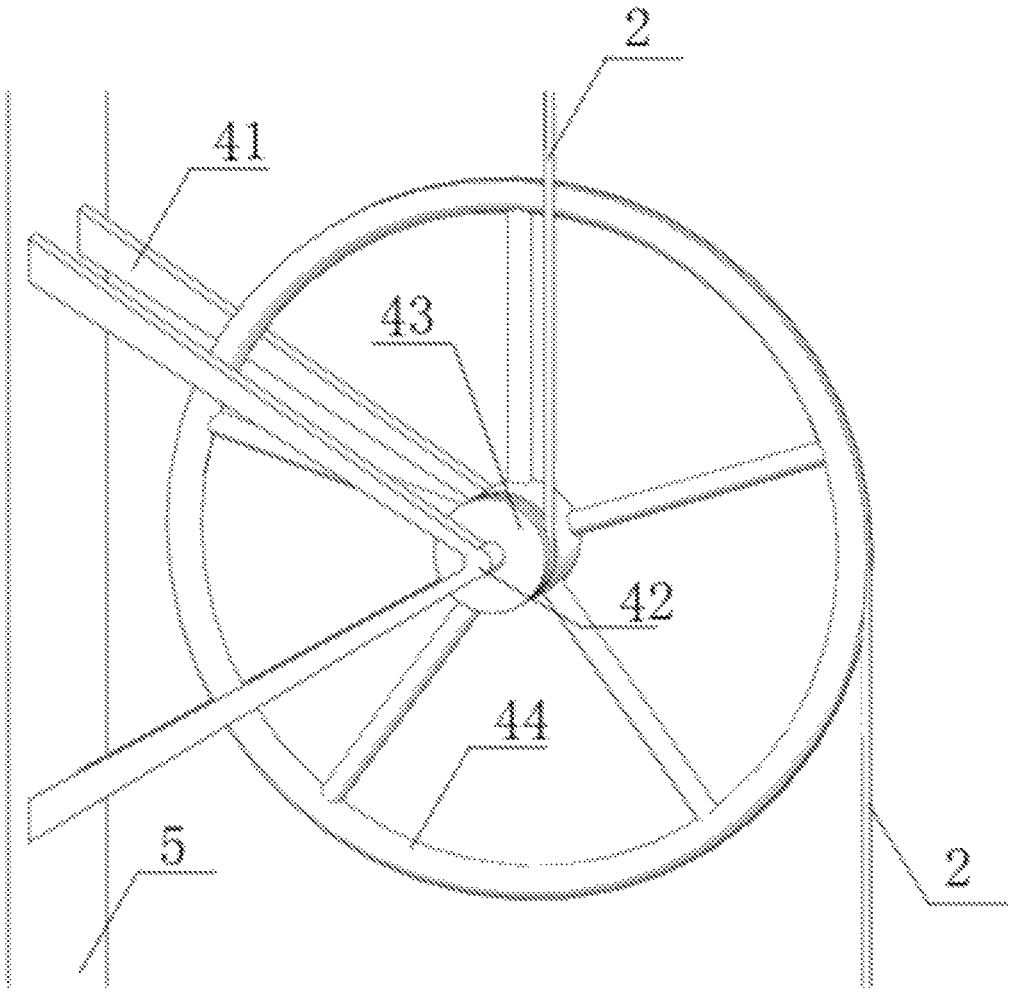
FIG. 4 is a structural representation of the displacement stroke amplifier provided by the present application.
Figure 5:
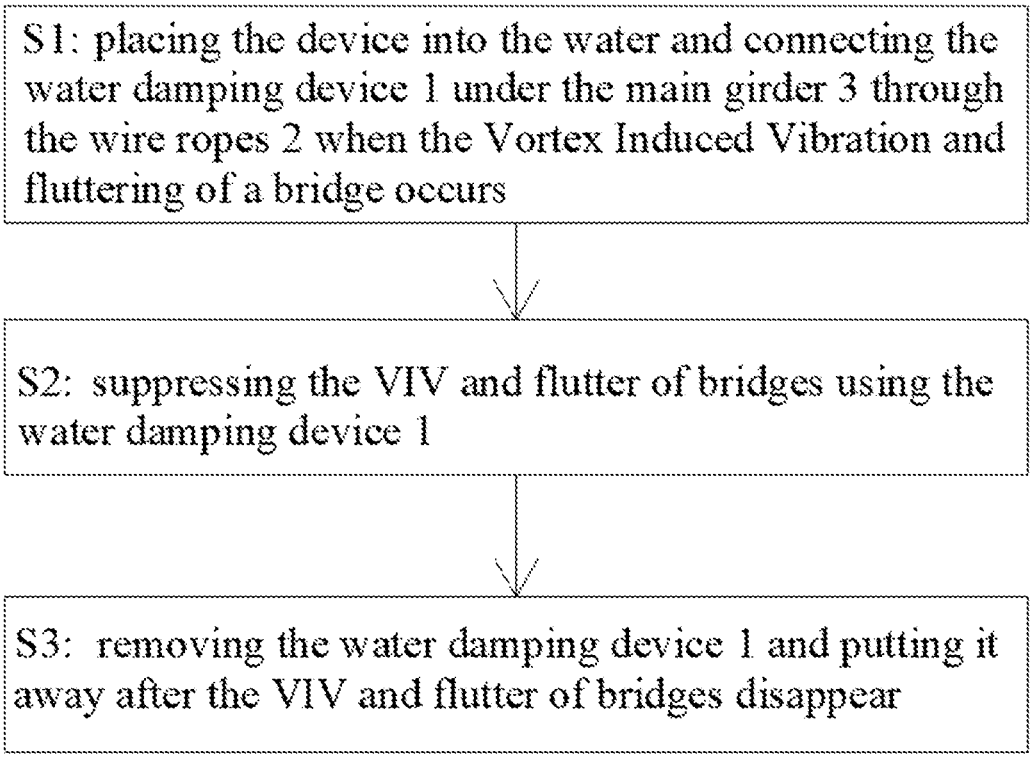
FIG. 5 is a flowchart representation of the method for controlling VIV and flutter of sea-crossing or river-crossing bridges.
Figure 6:
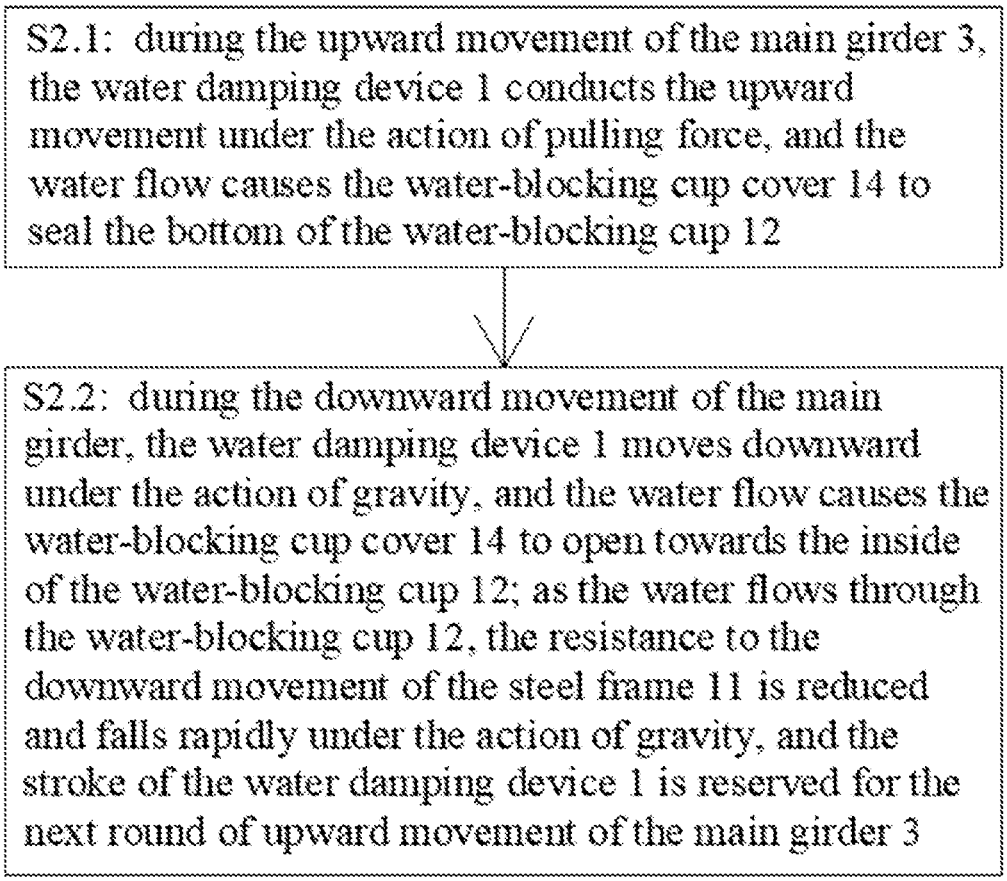
FIG. 6 is a flowchart representation of the Step S2.

The present embodiment provides a water damping device that controls the VIV and flutter of sea-crossing and river-crossing bridges, as shown in FIGS. 1 to 4. It includes the water damping devices 1 that are connected to the anchoring hole opened at the bottom of the main girder 3 by wire ropes 2 and are immersed in the water. The water damping devices 1 are mounted at points ½, ¼, and ⅛ of the length of the main girder 3. The water damping devices 1 include a steel frame 11 and a water-blocking cup 12. One end of the water-blocking cup 12 is provided with a blocking ring 13 and a water-blocking cup cover 14. The water-blocking cup cover 14 is mounted between the water-blocking cup 12 and the blocking ring 13 and is movably connected to the water-blocking cup 12. The blocking ring 13 is used to prevent the water-blocking cup cover 14 from opening towards the outside of the water blocking cup 12; the water-blocking cup 14 is made of light materials, such as aluminum alloy. The steel frame 11 and the water-blocking cup 12 are made of high-density materials, such as stainless steel. A plurality of water-blocking cups 12 is mounted on the steel frame 11 according to the downward direction of the water blocking cup cover 14. The water damping device 1 adjacent to the two ends of the main girder 3 is connected to a displacement stroke amplifier 4. The displacement stroke amplifier 4 is mounted on the bridge tower 5.

The displacement stroke amplifier 4 comprises a reinforced rigid arm 41, a solid steel shaft 42, a small-radius roller 43, and a large-radius hub 44; one end of the reinforced rigid arm 41 is connected to the bridge tower 5, and the other end is connected to the small-radius roller 43; the solid steel shaft 42 is embedded in the small-radius roller 43 through balls; the large-radius hub 44 and the small-radius roller 43 are coaxially fixed; a groove is provided on the outer side of the small-radius roller 43, one end of the wire ropes 2 is wound in the groove on the outer side of the small-radius roller 43, and the other end is connected to the main girder 3; a groove is provided on the outer side of the large-radius hub 44; one end of the wire ropes 2 is wound in the groove on the outer side of the large-radius hub 44, and the other end is connected to the water damping device 1.

In this embodiment, based on the configuration of the blocking ring 13, the water-blocking cup cover 14 can be opened towards the inside of water-blocking cups 12 but cannot open towards the outside of the water-blocking cups 12. When the main girder 3 moves upward, the water damping device 1 conducts the upward movement under the action of pulling force, and the water flow causes the water-blocking cup cover 14 to seal the bottom of the water-blocking cups 12. This increases the resistance and damping to the upward movement of the main girder 3 and dissipates partial kinetic energy of the upward movement of the main girder 3. When the main girder 3 moves downward, the water damping device 1 moves downward under the action of gravity, and the water flow causes the water-blocking cup cover 14 to open towards the inside of the water-blocking cup 12; as the water flows through the water-blocking cup 12, the resistance to the downward movement of the steel frame 11 is reduced and falls rapidly under the action of gravity, and the stroke of the water damping device 1 is reserved for the next round of upward movement of the main girder 3.

Based on the configuration of water damping device 1 on both sides of the main girder 3, when the torsional vibration of the main girder 3 occurs, the water damping device at the raised end of the main girder 3 hinders the torsion of the main girder 3, so as to control the torsional VIV and soft flutter. The setting of the water damping devices 1 at points ½, ¼, and ⅛ of the length of the main girder 3 achieves the effect of controlling the first-order, second-order, and third-order VIVs. Based on the configuration of anchoring holes at the bottom of the main girder 3, the water damping device is placed into the water and is connected by wire ropes 2 to exert the effect of suppressing VIV of the bridge; when the VIV of the bridge disappears and the wind environment of bridge deck is stabilized, wire ropes 2 are removed through the anchoring holes of the main girder 3, and the water damping devices 1 are detached and put away. This will not affect the underwater navigation or the aesthetics of the bridge.

Because the vibration displacement of the main girder 3 adjacent to the side span of the bridge tower 5 is relatively small, the displacement stroke of the water damping device 1 is too few to achieve a great control effect. Therefore, the stroke of the water damping device 1 is amplified by installing the displacement stroke amplifier 4 onto the bridge tower 5. This can achieve the effect of suppressing the vibration of the main girder 3. The displacement stroke amplifier 4 is connected to the bridge tower 5 through a reinforced rigid arm 41, and the solid steel shaft 42 is embedded in the small-radius roller 43 through balls. In this way the small-radius roller 43 and the solid steel shaft 42 can rotate coaxially. A groove is provided outside the small-radius roller 43. One end of the wire rope 2 is wound around and connected to the groove, and the other end is connected to the main girder 3. Moreover, the vertical displacement of the main girder 3 is converted into the circumferential displacement of the small-radius roller 43. The large-radius hub 44 is securely mounted on the small-radius roller 43. One end of wire rope 2 is wound in the groove on the outer side of the large-radius hub 44, and the other end of wire rope 2 is connected to the water damping device 1. Under the same angular displacement, the vibration displacement of the main girder 3 is amplified by the multiple between the large-radius hub 44 and the small-radius roller 43. This enables the water damping device 1 to exert the damping effect, thereby suppressing VIV and soft flutter of the bridge. It should be noted that the present application is mainly used to control VIV and flutter but is not limited thereto and can control other forms of vibration with large amplitudes, such as wind-induced buffeting.

Embodiment 2

The embodiments provide a method for controlling VIV and flutter of sea-crossing or river-crossing bridges. The method is implemented using the aforesaid water damping device 1 as a tool and comprises the following steps:

S1: Placing the device into the water and connecting the water damping device 1 under the main girder 3 through the wire ropes 2 when the Vortex Induced Vibration and fluttering of a bridge occurs.

S2: Suppressing the VIV and flutter of bridges using the water damping device 1.

S3: Removing the water damping device 1 and putting it away after the VIV and flutter of bridges disappear.

Step S2 is specifically implemented as below:

S2.1: During the upward movement of the main girder 3, the water damping device 1 conducts the upward movement under the action of pulling force, and the water flow causes the water-blocking cup cover 14 to seal the bottom of the water-blocking cup 12. This increases the resistance and damping to the upward movement of the main girder 3 and dissipates partial kinetic energy of the upward movement of the main girder 3;

S2.2: During the downward movement of the main girder, the water damping device 1 moves downward under the action of gravity, and the water flow causes the water-blocking cup cover 14 to open towards the inside of the water-blocking cup 12; as the water flows through the water-blocking cup 12, the resistance to the downward movement of the steel frame 11 is reduced and falls rapidly under the action of gravity, and the stroke of the water damping device 1 is reserved for the next round of upward movement of the main girder 3. Accordingly, the water damping device 1 has a strong enough stroke to dissipate the vibration energy of the main girder 3 during the next round of upward movement.

In the present embodiment, based on the damping effect of water, the process of energy dissipation is ongoing as long as the main girder 3 moves upward. Therefore, the device has great control robustness and can effectively control the multi-order VIVs by the configuration of multi-span positions. The device provided by the present application is mounted directly outside the main girder 3 and can be detached when not in use. The device neither increases the weight of the main girder 3 nor affects the aesthetics of the main girder 3 and is easy to install if required. Moreover, its maintenance cost is low, and it is suitable for controlling various types of sections of the main girder 3. The device can dissipate the vibration energy of the main girder 3 as long as it moves upward. Hence the vibration of the main girder 3 can be controlled at any order and frequency, and the vibration in the torsional direction of the main girder 3 can be well controlled. The device provided by the application is featured by a simple structure and cost-effectiveness and makes full use of the damping and energy dissipation effects of the water environment. The device can be installed and removed at the position where the vibration of the main girder 3 is the most obvious. Due to its convenience and flexibility, the device has the value of extensive popularization and application and can control any significant vibration of the main girder 3 in the vertical and torsional directions. In particular, it can well control the vibration behavior in complex and extreme wind environments.

Obviously, the foregoing embodiments are intended only to elaborate the examples listed, rather than to restrict the mode of implementation. For those of ordinary skill in the art, changes or modifications in other forms can also be made on the basis of the foregoing description. It is not necessary to give an exhaustive list of all implementation modes. Any obvious changes or modifications derived therefrom still fall within the protection scope of the present application.

The invention claimed is:

1. A water damping device for controlling vortex-induced vibration and flutter of sea-crossing or river-crossing bridges, comprising a water damping device, wherein the water damping device is connected under a main girder by wire ropes and immersed in the water; the water damping device comprises a steel frame and a water-blocking cup, one end of the water-blocking cup is provided with a blocking ring and a water-blocking cup cover, the water-blocking cup cover is mounted between the water-blocking cup and the blocking ring and is movably connected to the water-blocking cup, the blocking ring is used to prevent the water-blocking cup cover from opening towards the outside of the water-blocking cup; an array of water-blocking cups is mounted on the steel frame along the downward direction of the water-blocking cup cover;

further comprising a displacement stroke amplifier, wherein the displacement stroke amplifier is mounted on the bridge tower adjacent to both ends of the main girder and is connected to the water damping device;

the displacement stroke amplifier comprises a reinforced rigid arm, a solid steel shaft, a small-radius roller, and a large-radius hub; one end of the reinforced rigid arm is connected to the bridge tower, and the other end is connected to the small-radius roller; the solid steel shaft is embedded in the small-radius roller through balls; the large-radius hub and the small-radius roller are coaxially fixed; and a groove is provided on the outer side of the small-radius roller; one end of the wire ropes is wound in the groove on the outer side of the small-radius roller, and the other end is connected to the main girder; a groove is provided on the outer side of the large-radius hub; one end of the wire ropes is wound in the groove on the outer side of the large-radius hub and the other end is connected to the water damping device.

2. The water damping device for controlling vortex-induced vibration and flutter of sea-crossing or river-crossing bridges according to claim 1, wherein the water damping devices are mounted at points ½, ¼, and ⅛ of a length of the main girder.

3. The water damping device for controlling vortex-induced vibration and flutter of sea-crossing or river-crossing bridges according to claim 1, further comprising an anchoring hole opened at the bottom of main girder; wherein the water damping device is connected to the anchoring hole through the wire ropes.

4. The water damping device for controlling vortex-induced vibration and flutter of sea-crossing or river-crossing bridges according to claim 1, wherein the water damping devices are mounted on both sides of the bridge.

5. The water damping device for controlling vortex-induced vibration and flutter of sea-crossing or river-crossing bridges according to claim 1, wherein the water-blocking cup cover is made of lightweight materials; the steel frame and the water-blocking cup are made of high-density materials.

6. A method for controlling vortex-induced vibration and flutter of sea-crossing or river-crossing bridges, wherein the method makes use of the water damping device according to claim 1 and comprises following steps:

S1: placing the device into the water and connecting the water damping device under the main girder through the wire ropes when the Vortex Induced Vibration and fluttering of a bridge occurs;

S2: suppressing the Vortex Induced Vibration and fluttering of bridges using the water damping device; and S3: removing the water damping device and putting it away after the Vortex Induced Vibration and fluttering of bridges disappear.

7. The method for controlling vortex-induced vibration and flutter of sea-crossing or river-crossing bridges according to claim 6, wherein S2 comprises:

S2.1: during an upward movement of the main girder, the water damping device conducting the upward movement under the action of pulling force, and the water flow causing the water-blocking cup cover to seal the bottom of the water-blocking cup so as to increase the resistance and damping force to the upward movement of the main girder and dissipate partial kinetic energy of the upward movement of the main girder; and S2.2: during a downward movement of the main girder, the water damping device moving downward under the action of gravity, the water flow causing the water-blocking cup cover to open towards the inside of the water-blocking cup and the water flowing through the water-blocking cup so that the resistance to the downward movement of the steel frame is reduced and falls rapidly under the action of gravity; the stroke of the water damping device being reserved for the next round of upward movement of the main girder so that the water damping device has a strong enough stroke to dissipate the vibration energy of the main girder during the next round of upward movement.

* * * * *